US011608553B2

(12) United States Patent
Stevenson et al.

(10) Patent No.: US 11,608,553 B2
(45) Date of Patent: Mar. 21, 2023

(54) WIRE ARC SPRAY SWIVEL HEAD

(71) Applicants: Alexander D. Stevenson, Tusket (CA); Robert Anthony McDemus, Washington, PA (US)

(72) Inventors: Alexander D. Stevenson, Tusket (CA); Robert Anthony McDemus, Washington, PA (US)

(73) Assignee: Robert Anthony McDemus, Washington, PA (US)

( * ) Notice: Subject to any disclaimer, the term of this patent is extended or adjusted under 35 U.S.C. 154(b) by 12 days.

(21) Appl. No.: 15/932,808

(22) Filed: Apr. 26, 2018

(65) Prior Publication Data

US 2018/0327891 A1 Nov. 15, 2018

Related U.S. Application Data

(60) Provisional application No. 62/606,706, filed on Oct. 3, 2017.

(51) Int. Cl.

| | |
|---|---|
| ***C23C 4/131*** | (2016.01) |
| ***C23C 4/08*** | (2016.01) |
| ***C23C 4/14*** | (2016.01) |
| ***B05B 13/02*** | (2006.01) |
| ***B05B 13/04*** | (2006.01) |
| ***B05B 15/652*** | (2018.01) |
| *B05B 7/22* | (2006.01) |

(52) U.S. Cl.

CPC ..... *C23C 4/131* (2016.01); *B05B 13/0214* (2013.01); *B05B 13/0415* (2013.01); *B05B 15/652* (2018.02); *C23C 4/08* (2013.01); *C23C 4/14* (2013.01); *B05B 7/224* (2013.01); *B05B 13/0405* (2013.01); *B05B 13/0431* (2013.01)

(58) Field of Classification Search

CPC .. C23C 4/131; C23C 4/08; C23C 4/14; B05B 13/0214; B05B 13/0415; B05B 13/0431

USPC ..... 219/121.47, 121.48, 121.49, 121.5, 219/121.51, 121.54, 121.55, 121.56, 219/121.57, 121.58; 427/446, 449, 457, 427/458, 461, 480, 484, 580, 587, 591

See application file for complete search history.

(56) References Cited

U.S. PATENT DOCUMENTS 3,546,415 A * 12/1970 Marantz ..... B05B 7/224 219/76.14
4,143,930 A * 3/1979 Schauer ..... H01R 39/00 439/23
4,353,677 A * 10/1982 Susnjara ..... B05B 13/0431 414/4
5,316,219 A * 5/1994 Christyson ..... B05B 13/0431 239/101
5,707,693 A * 1/1998 Vliet ..... B05B 7/224 219/76.15
5,990,443 A 11/1999 Tatham et al.
6,796,519 B1 * 9/2004 Knobbe ..... B05B 1/04 239/690

(Continued)

OTHER PUBLICATIONS

The Lincoln Electric Company, "How a Plasma Cutter Works," 4 pages, 1999-2020.

*Primary Examiner* — Justin C Dodson
(74) *Attorney, Agent, or Firm* — Christopher John Rudy

(57) ABSTRACT

Device for spray coating embraces a wire arc spray head that includes arc-making contact points and a carrier gas outlet, which is configured to swivel with feed wire in a pivoting motion. The device can be operated to spray coat a work piece.

20 Claims, 12 Drawing Sheets

(56) References Cited

U.S. PATENT DOCUMENTS

| | | | | |
|---|---|---|---|---|
| 7,432,469 | B2 * | 10/2008 | Nakahama | B05B 7/224 219/121.47 |
| 8,957,346 | B2 * | 2/2015 | Kodama | B05B 7/224 219/121.47 |
| 2003/0085681 | A1 * | 5/2003 | Sakamoto | B25J 9/042 318/568.16 |
| 2005/0186355 | A1 * | 8/2005 | Miyamoto | C23C 4/131 427/446 |
| 2007/0069042 | A1 * | 3/2007 | Tujii | B05B 3/02 239/84 |
| 2014/0138360 | A1 * | 5/2014 | Hansen | B23K 9/323 219/121.44 |
| 2015/0374882 | A1 | 12/2015 | McDemus et al. | |

* cited by examiner

WIRE ARC SPRAY SWIVEL HEAD

This claims the priority benefits under 35 USC 119(a-d) of Canadian patent application No. CA 2,965,926 filed on May 3, 2017 A.D., and under 35 USC 119(e) of U.S. provisional patent application No. U.S. 62/606,706 filed on Oct. 3, 2017 A. D. The specifications of those applications, including any drawings, are incorporated herein by reference in their entireties.

FIELD AND PURVIEW OF THE INVENTION

Of concern are a wire arc spray head that includes arc-making contact points and a carrier gas outlet, which can swivel with, feed wire in a pivoting motion, a sprayer including the head, and use thereof. Thus, as one example, the head can be an air-carried, zinc wire arc spray, robotic spraying torch head, its spray tip selectively swivelable in a 180-degree arc in a plane in which a central axis of the head lies, with a first operating position found at a 90-degree angle from the central axis, a second operating position opposite the first operating position, and further operating positions intermediate the first and second operating positions. As another, the head can be an air-carried, zinc wire arc spray, manually adjustable spraying torch head, its spray tip selectively swivelable through a 90-degree arc in a plane in which a central axis of the head lies, with a first operating position at a 90-degree angle from the central axis, a second operating position in or parallel with the central axis, and further operating positions intermediate the first and second operating positions. There may be further structure, say, a gantry external the torch for robotic or remote spraying, or a swivel stop internal the torch, say, in a manual torch.

BACKGROUND TO THE INVENTION

Wire arc spray torches are widely employed to coat workpieces with spray coatings. One of the difficulties with use of existing wire arc spray torches is that of inconsistent coating.

On one hand, known automatic arc spray torches with robotic control can provide more consistent coatings, particularly when the position of the workpiece with respect to the torch head is readily accessible. On the other hand, when using conventionally designed units to spray a position that is not readily accessible, the spray coating may be well-nigh impossible to apply or compromised if it can be applied, and even the sprayer may be compromised from its use. For example, when spray coating a steel I-beam, spray from the torch head must be redirected over a 180-degree range so that the torch head is moved to be oriented in downward facing vertical, horizontal, and upward facing vertical positions.

Since standard robotic wire arc spray torch sprayer designs do not allow for easy robotic movements and such movement would put great stress on the torch cable, the current manner of wire arc spray coating I-beams is by manual spraying, i.e., spraying with a hand held torch head. Manual spraying, however, may also leave an inconsistent coating. For example, with sprayed bridge I-beams, inconsistently coated sections rust before their intended time, and require costly touch-ups. Manual spraying also is labor intensive and time consuming. For example, in manual spraying 150-foot I-beams for bridge girders, operators face various hazards and need time to rest, with accidents, injuries, replacement operators, and inefficient production engendered.

Manual spraying, however, does have its advantages. These include particularly directed spray, often on workpieces that have complex surface shapes, are one-of-a-kind, or are in need of spraying here-and-there such as in touch-up or repair, or are in remote locations in the field.

It would be desirable to ameliorate if not solve such problems. It would be desirable to provide the art an alternative, and provide for efficient spray coating of workpieces.

Discovery of Source of Problem

Among known, typically automatic, arc spray torches are those that have heads that provide for spray rotating about the central axis of the torch head. These have fixed feed wires, with only the gas-carried arc spray itself that has its direction changed by rotation of the head tip.

One of the characteristics of such existing arc spray torches is that they have fixed contact tips, which are typically made with copper. When the wires from these tips come together, an arc is struck, and compressed air from behind atomizes the molten material such as metal or a metal alloy formed from the arc. The compressed air comes from an air-directing tip, typically which has a round orifice and is made from plastic, and which is in line with and just behind the two fixed contact tips. The molten material mixed with air and usually in a form of minute particles or a fine spray, i.e., molten atomized material, is formed into a stream that streams out along with the flow of the compressed air from the air-directing tip. An extension may be provided as another tip, a stream-deflecting tip, typically which is in a form of a stationary tube having a generally rectangular extremity that may have an arcuately slotted orifice just in front of the fixed contact tips. The stream-deflecting tip blows compressed air into the stream of molten atomized material to change the angle of the stream: the greater the air pressure, the more the stream is deflected, up to a maximum approaching about ninety degrees. It is very difficult to spray a coating with integrity and get the stream to turn ninety degrees. It is desirable to be able to go a full ninety degrees, but that is not always accomplished owing to factors such as the composition of the material being melted, the settings of the power supply, air temperature, and other parameters affecting the melting. Also, a deflection of the stream greater than ninety degrees of arc, in general, is not possible because there is a practical limit as to how much compressed air can be applied before the coating quality becomes substandard, noting this would entail a reversal of momentum of the stream. See, FIG. 1PA.

Moreover, in addition to deflecting or turning the stream of molten atomized material, the stream-deflecting tip reduces the quality of the coating as it chills some of the molten atomized material too fast and creates increased porosity in the coating. Other factors may play a part.

It is still desirable, however, to spray consistent quality coatings through a radial arc.

Continued Disclosure of the Invention

Provided hereby is a device for spray coating, which comprises a wire arc spray head that includes arc-making contact points and a carrier gas outlet, which can swivel with feed wire in a pivoting motion. There may be further structure in addition to or within the head. Provided in turn is a method of coating a workpiece comprising steps, not necessarily conducted in series, of providing the workpiece for spraying; providing a device for spray coating, which includes the present wire arc spray head; providing wire feed stock in a solid state to the head of the device; swiveling the head in a pivoting motion to orient it in position for spraying the workpiece; providing electric power to the solid wire feed stock such that the solid wire feed stock is changed into a state suitable for spraying; providing a carrier gas under pressure to the device; passing the carrier gas by the feed stock changed into a suitable state for spraying to form a spray for coating the workpiece; and carrying the spray by the carrier gas to the work piece such that coating is carried out on the workpiece.

The invention is useful in coating.

Significantly, by the invention, the art is advanced in kind. Problems in the art are ameliorated if not solved, and the art is provided an alternative. Workpieces can be efficiently spray coated. Manual, automatic or semiautomatic device set-up and/or operation may be provided. Employment of the present head as a robotic end-effector provides for easy movement, with debilitating stress on the torch cable avoided. Thus, evenly applied coatings result, with longer times of spraying before wire jamming encountered, which means less down time in comparison to manual spraying. In a robotic embodiment, the present device avoids manual spraying, and its hazards and other inefficiencies. With further structure such as a gantry, notably in a robotic system, production can be increased dramatically over manual spraying, which cannot meet production requirements of a robotic system, to include in coating such workpieces as long-length steel I-beams for bridge girders, for example, those having a 150-foot length.

The invention is unique in that the arc-making contact points and carrier gas outlet can swivel along with feed wire in a pivoting motion. Possible now is a setting along or movement through a radial arc of nearly any suitable value, for example, a 15-degree arc, a 30-degree arc, a 45-degree arc, a 60-degree arc, a 90-degree arc, a 135-degree arc, a 180-degree arc, or thereabout and so forth. In general if not exactly, the same high quality coating can be obtained through the full radial arc.

In short, heretofore, contact tips were fixed with respect to an arc spray head. Hereby, contact tips are radially movable with respect to the arc spray head. As well, heretofore, compressed air was used to turn or deflect a stream of molten atomized material carried by compressed air. Hereby, the angle is changed at which the stream of molten atomized material carried by a carrier gas is actually, initially aimed, without deflection after the stream is formed.

Thus, highly consistent wire arc spray coatings are provided hereby.

Further advantages attend the invention.

DRAWINGS IN BRIEF

The drawings form part of the specification hereof with respect to the drawings, which are not necessarily drawn to scale, the following is briefly noted:

FIG. 1PA is a close-up view of an existing, prior art wire arc spray head.

FIG. 1 is a first side, plan view of a wire arc spray swivel head embodiment hereof. This may be considered to be a view of the "pinch side" of the head because it is taken in a direction facing the side on which a wire feed stock pinch roller mechanism is prominently depicted. This has a swiveling tip that may be operated automatically anywhere within an about 180-degree arc.

Figure 1P:
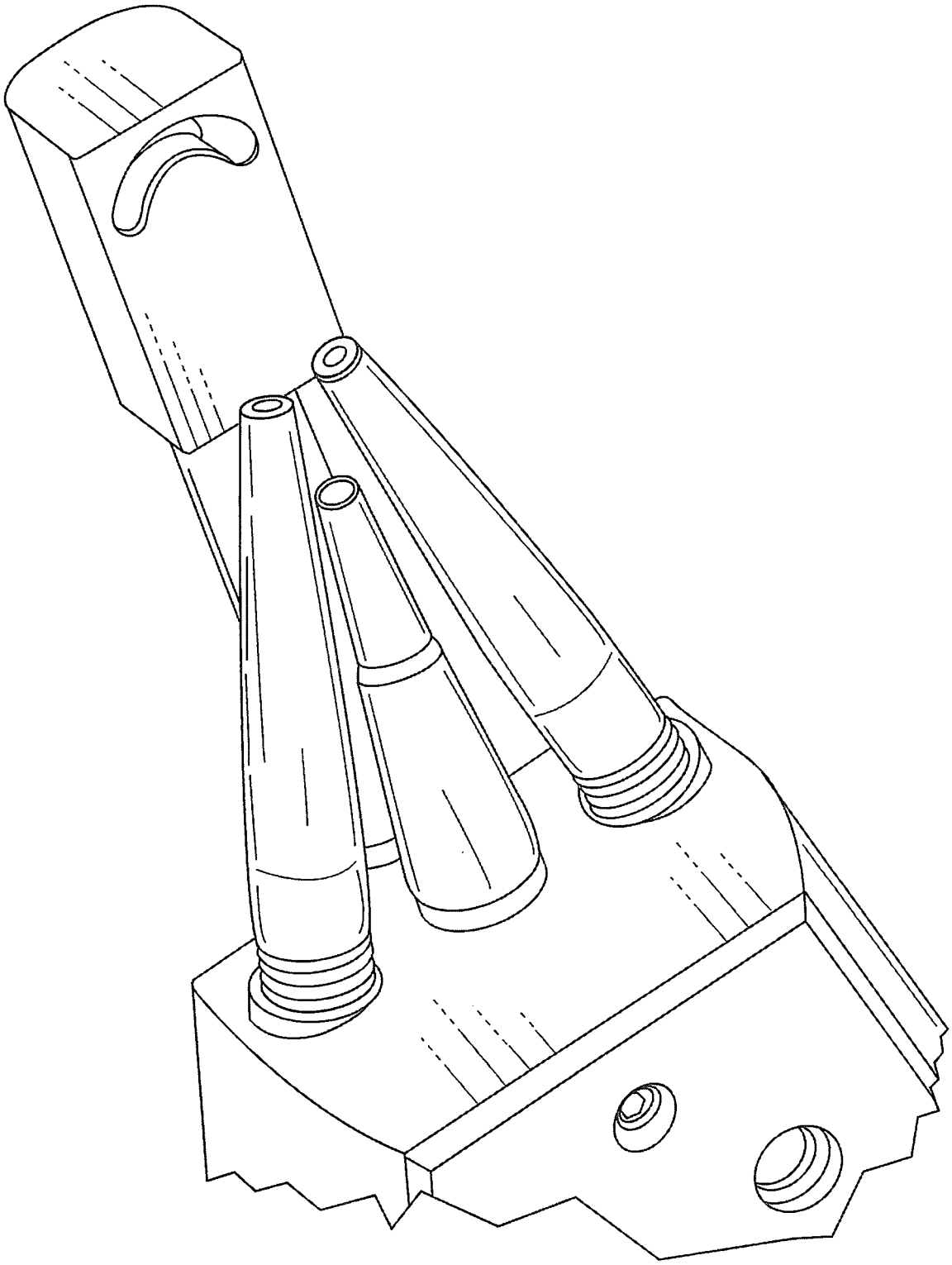
Fig. 1PA (Prior Art)
Figure 1:
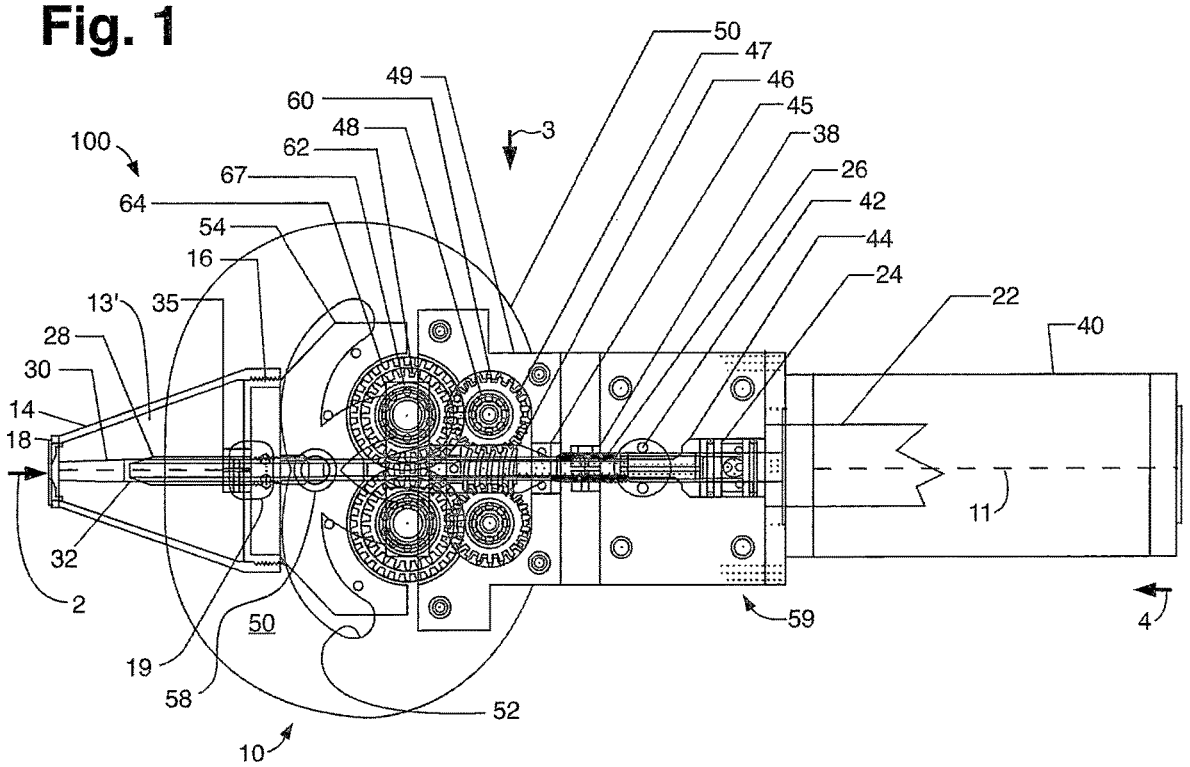
Figure 2:
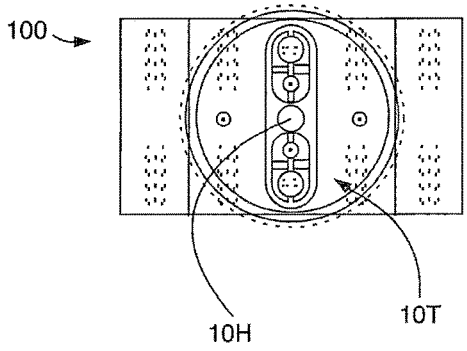
FIG. 2 is a front plan view of the head of, taken in the direction of arrow 2 in, FIG. 1.
Figure 3:
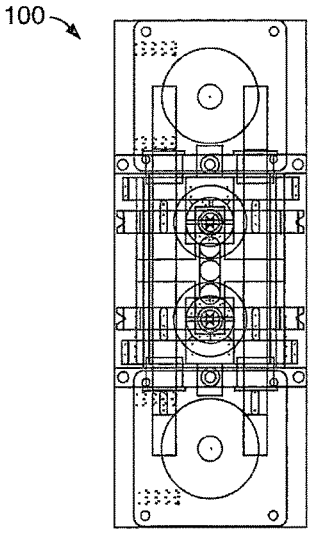
FIG. 3 is a rear plan view of the head of, taken in the direction of arrow 4 in, FIG. 1.
Figure 4:
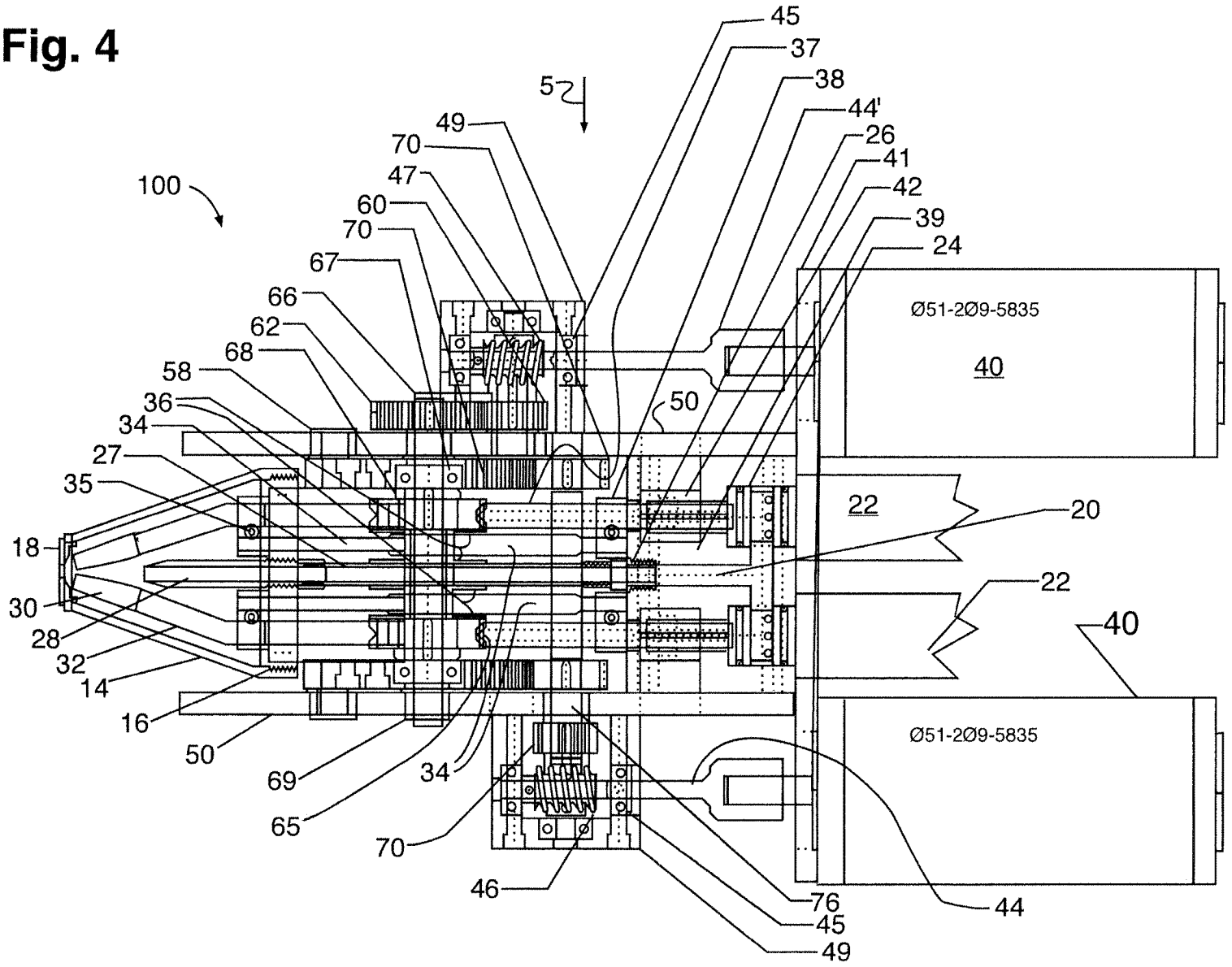
FIG. 4 is a top plan view of the head of, taken in the direction of arrow 3 in, FIG. 1.
Figure 5A:
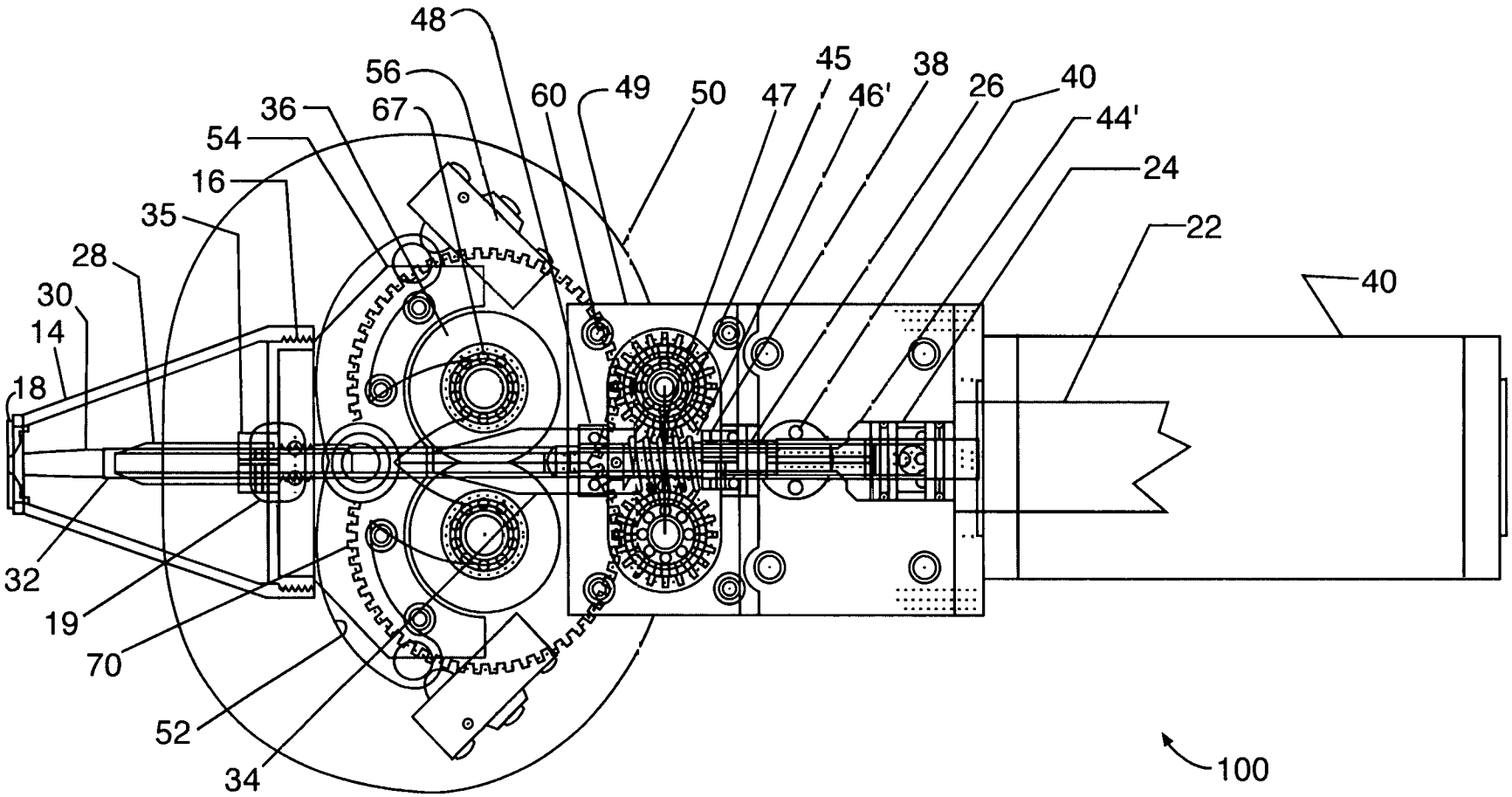
Figure 5B:
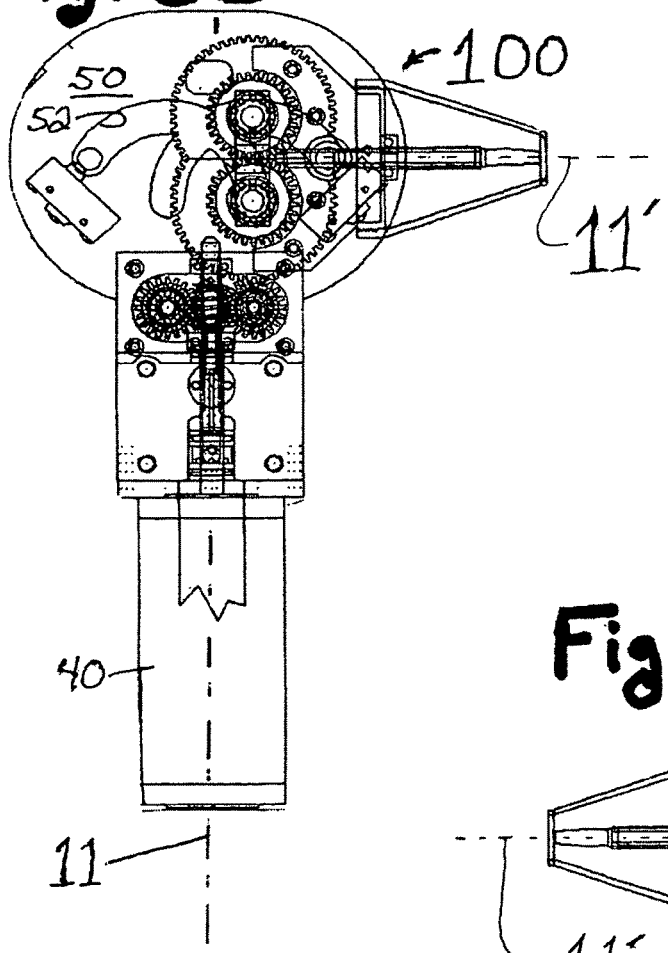
Figure 5C:
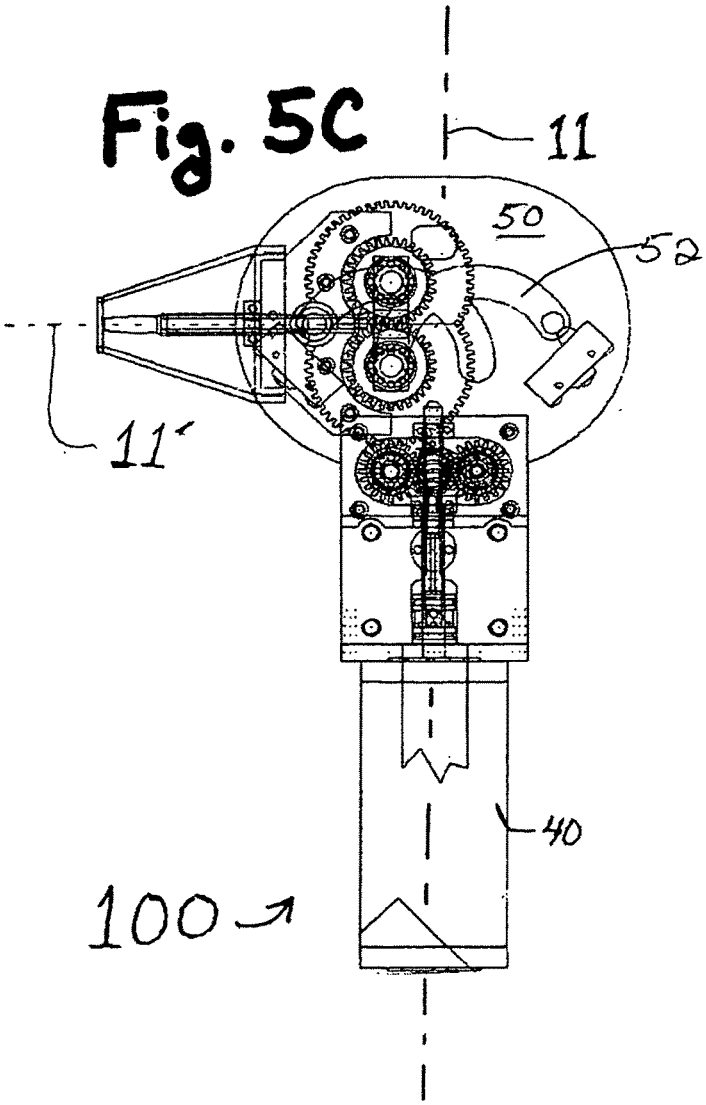
Figure 5D:
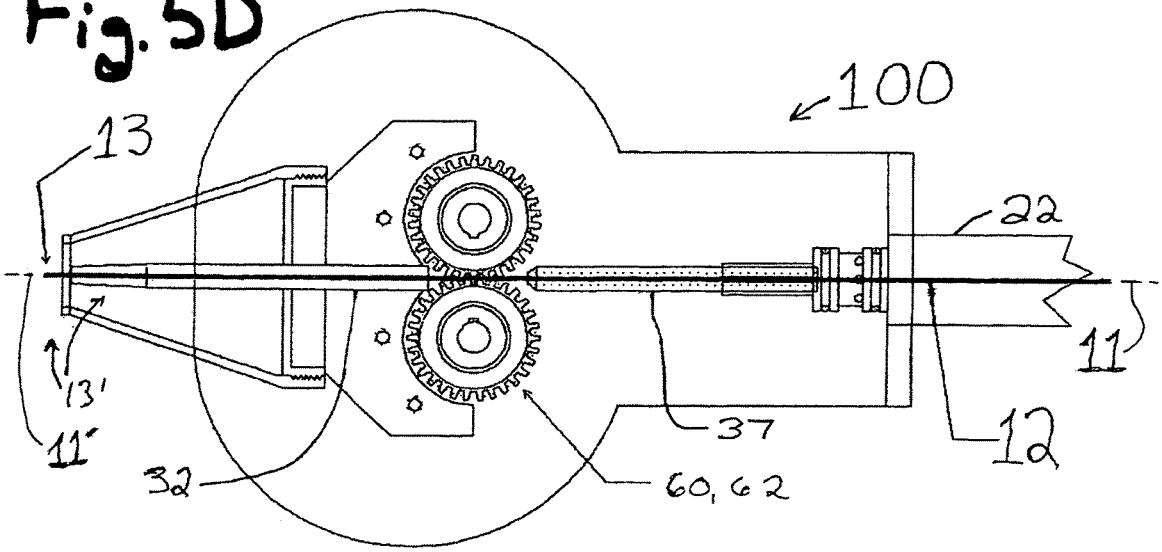
Figure 5E:
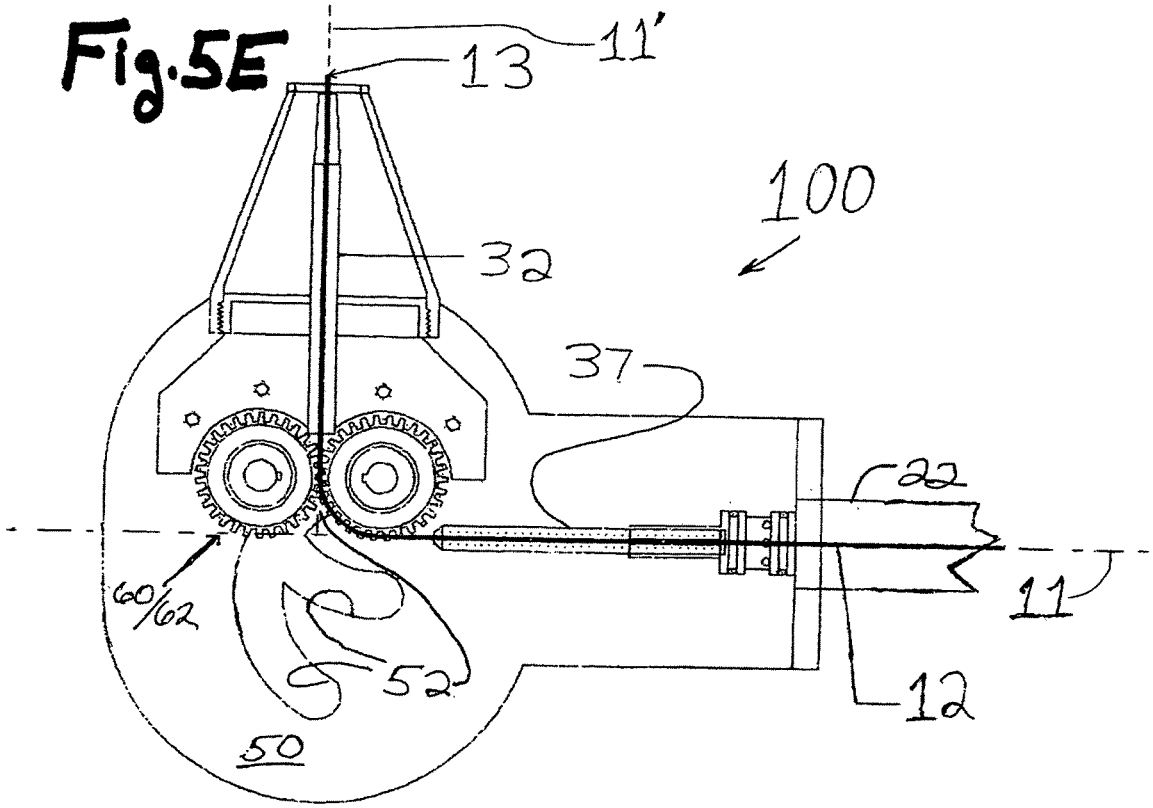

FIGS. 5A-5E are second side, plan views of the head of FIG. 1, taken in the direction of arrow 5 in FIG. 4 with initial reference to FIG. 5A, with FIG. 5A having the tip of its head in a position running along or parallel with a central axis of the head, which may be considered to be an intermediate position; FIG. 5B having the tip of its head in a first position at a 90-degree angle to the central axis; FIG. 5C having the tip of its head in a second position opposite the first position; FIG. 5D is a view akin to FIG. 5A but depicting wire feeding therein; and FIG. 5E is a view akin to FIG. 5B, but depicting wire feeding therein. These views may be considered to be views of the "tilt side" of the head because they are taken in the direction facing the side on which a head swiveling mechanism is prominently depicted.

Figure 6:
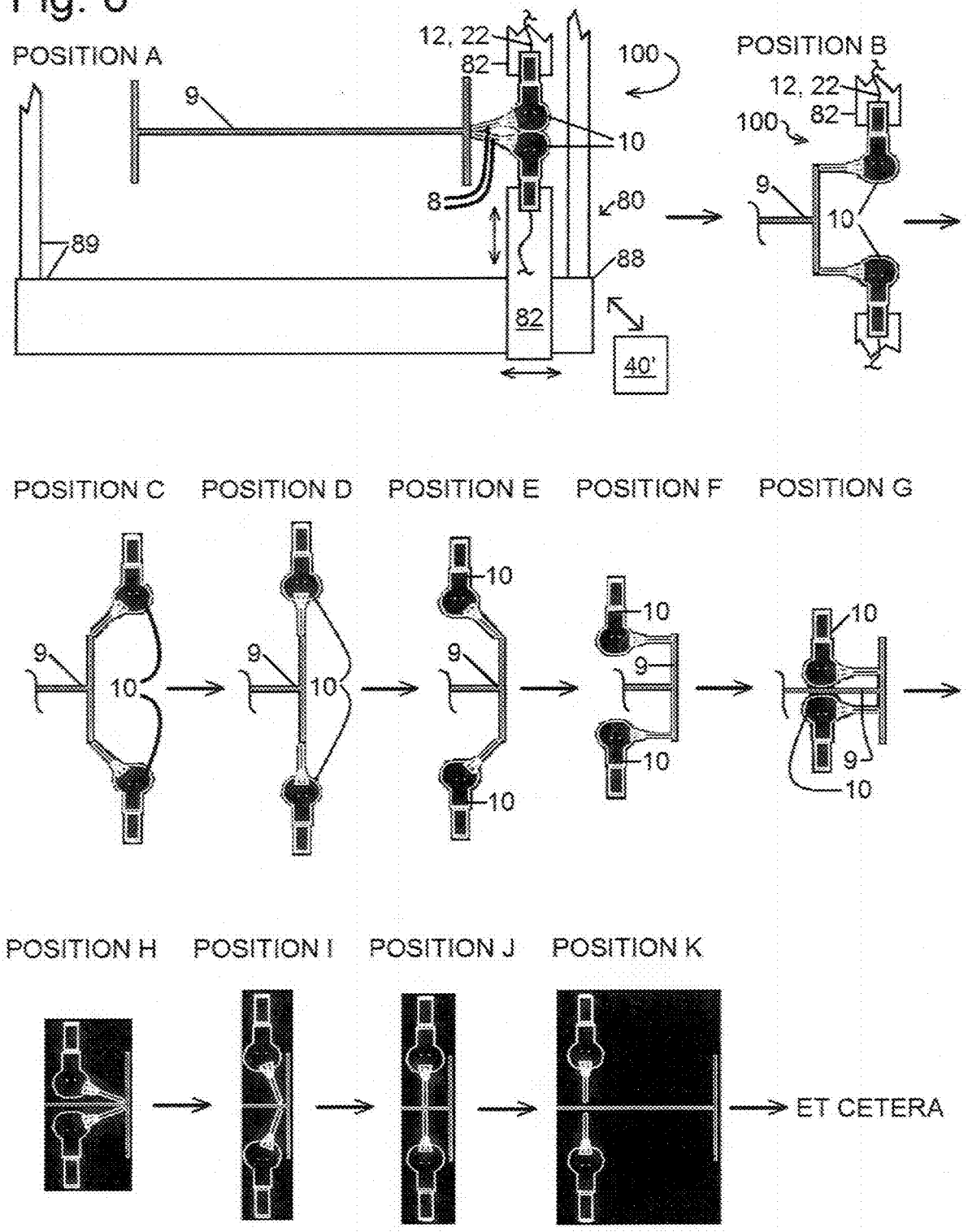

FIG. 6 is a view of the head of FIG. 1 attached to further structure, to include a gantry, for robotic operation as a device for spray coating, stepwise spray coating an I-beam.

Figure 7:
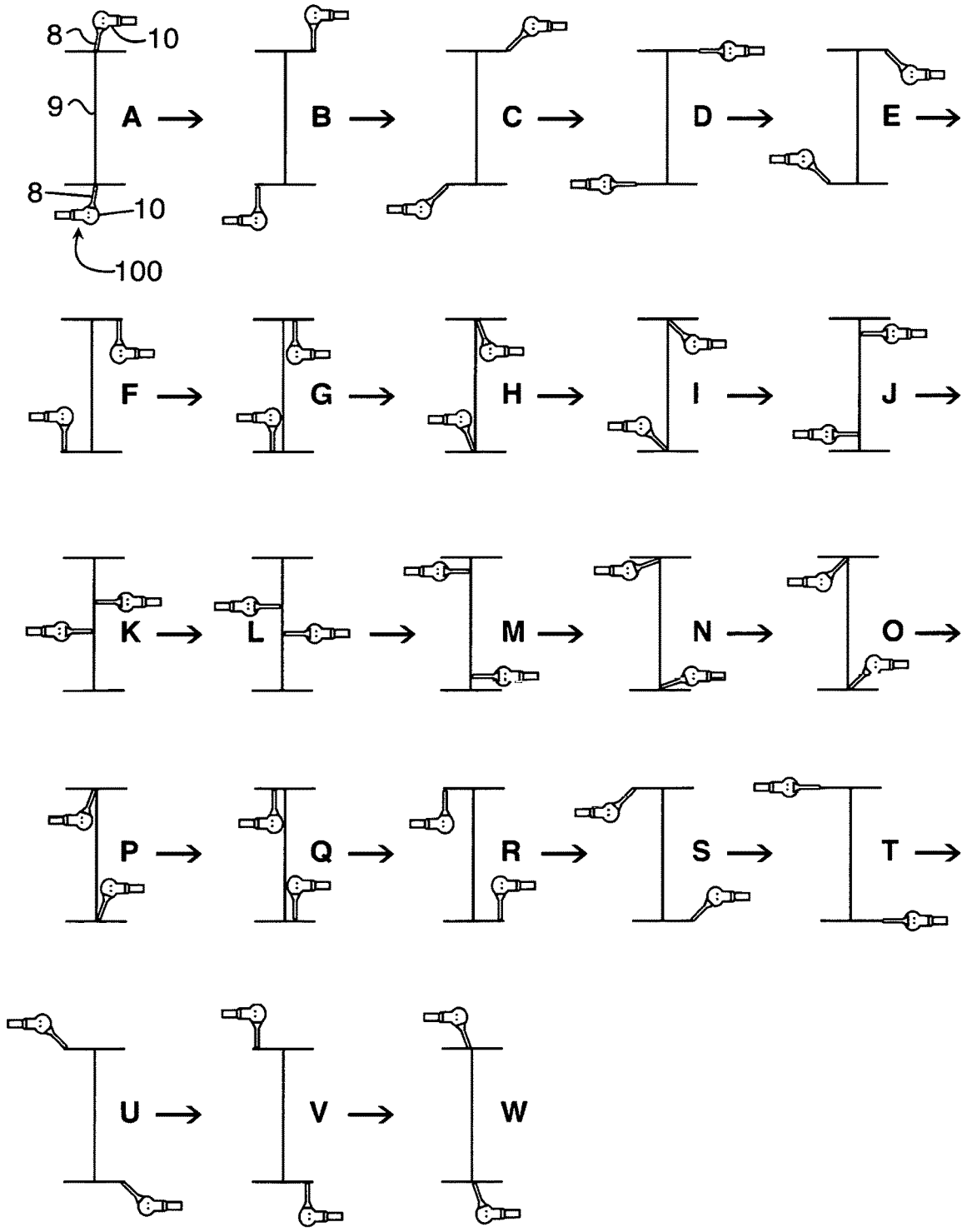

FIG. 7 is a view of the head of FIG. 1 shown robotically spray coating an I-beam in another series of steps (further structure not depicted).

Figure 8:
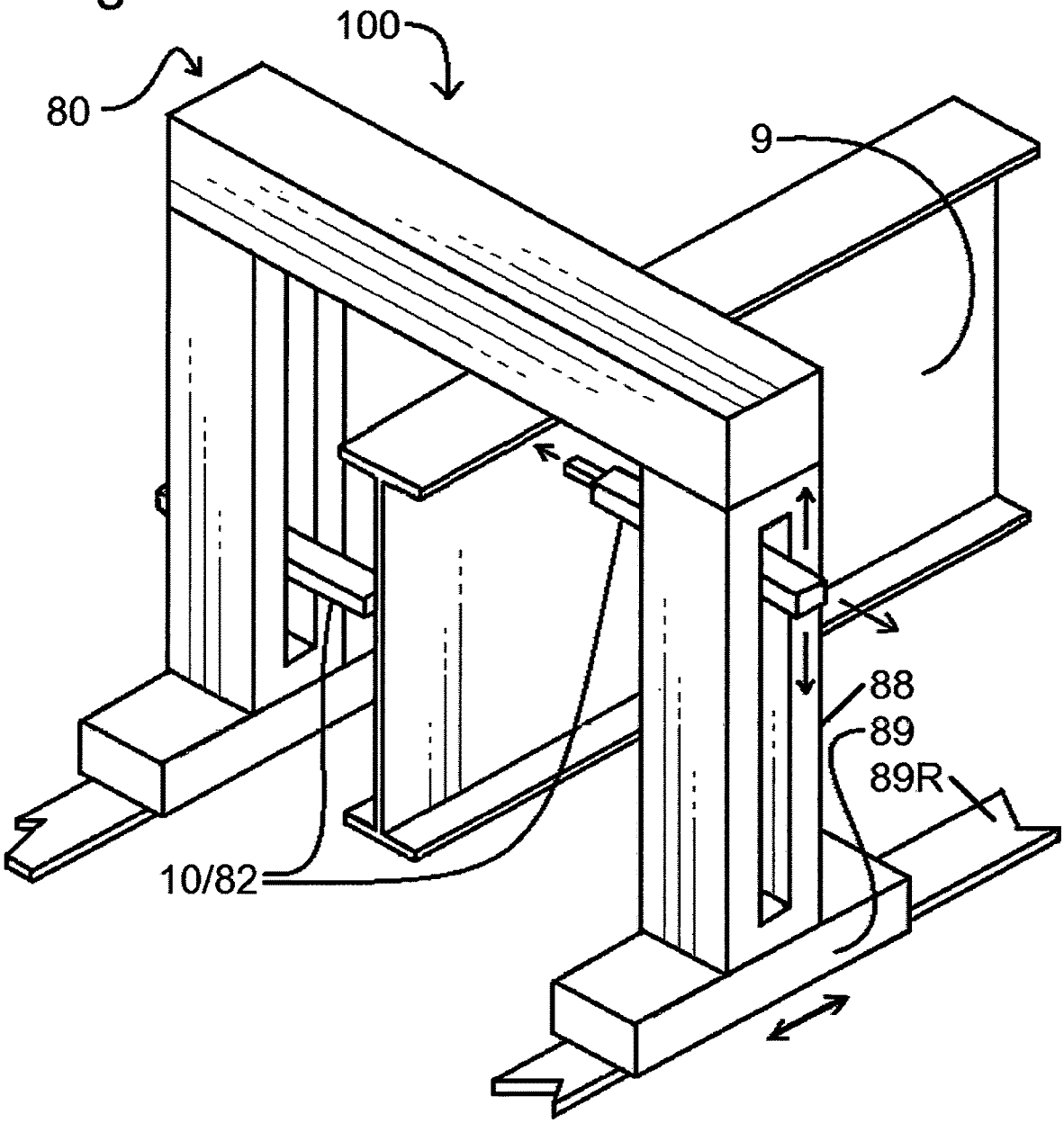

FIG. 8 is a view of a gantry employable with the head of FIG. 1. This provides for at least one motion in addition to that provided by the pivoting motion of the wire arc spray swivel head such as to spray the workpiece, here, an I-beam.

Figure 9A:
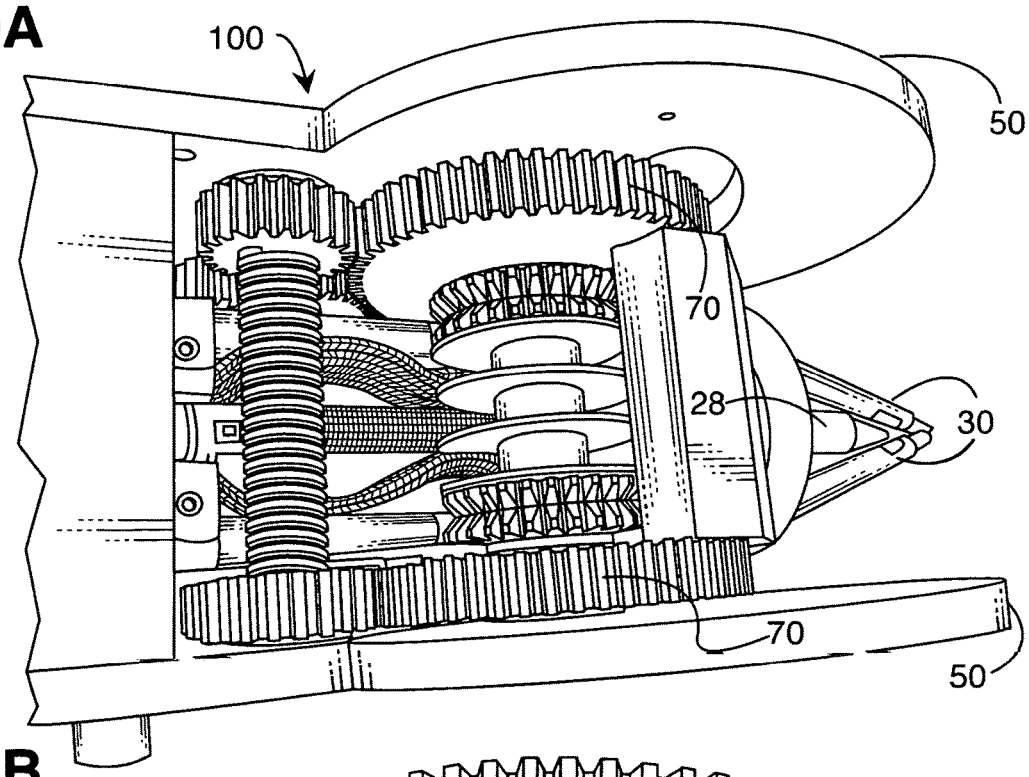
Figure 9B:
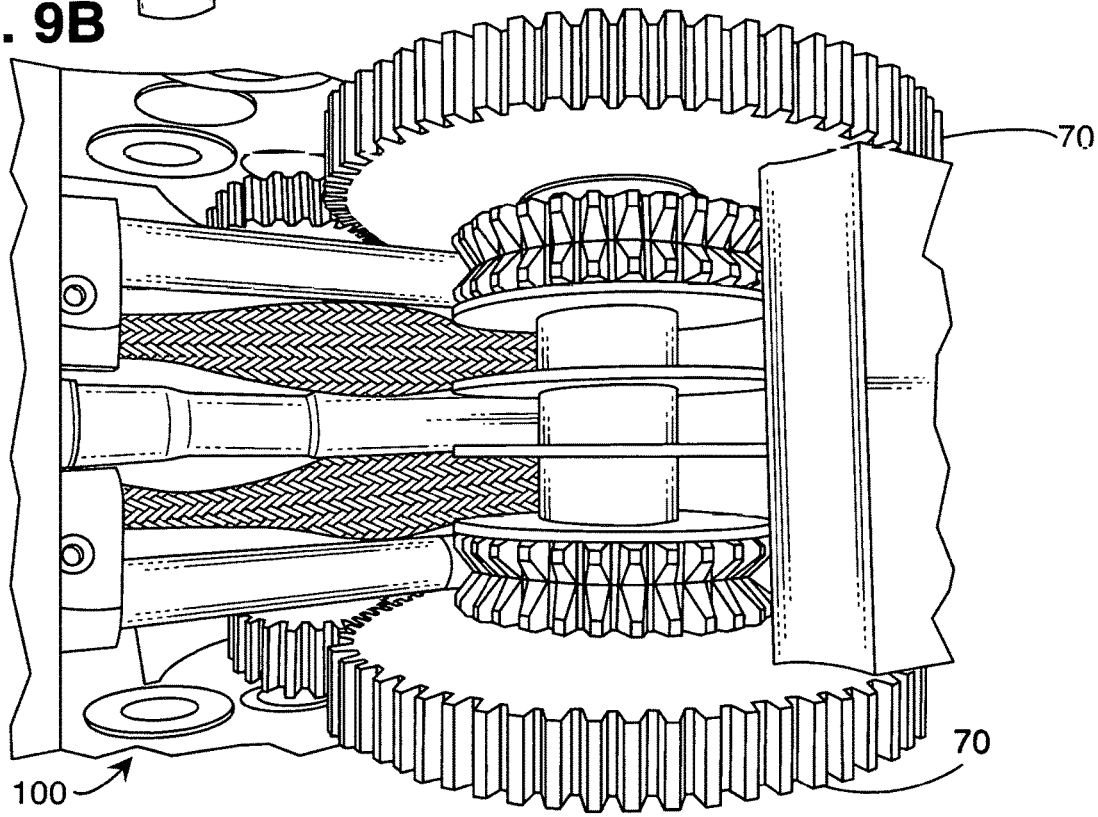
Figure 9C:
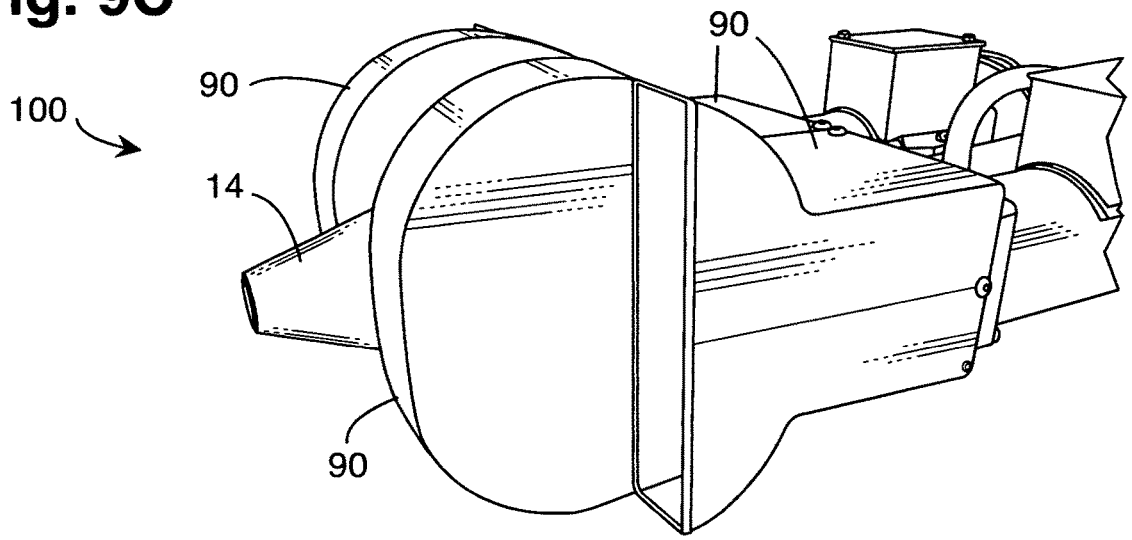
Figure 9D:
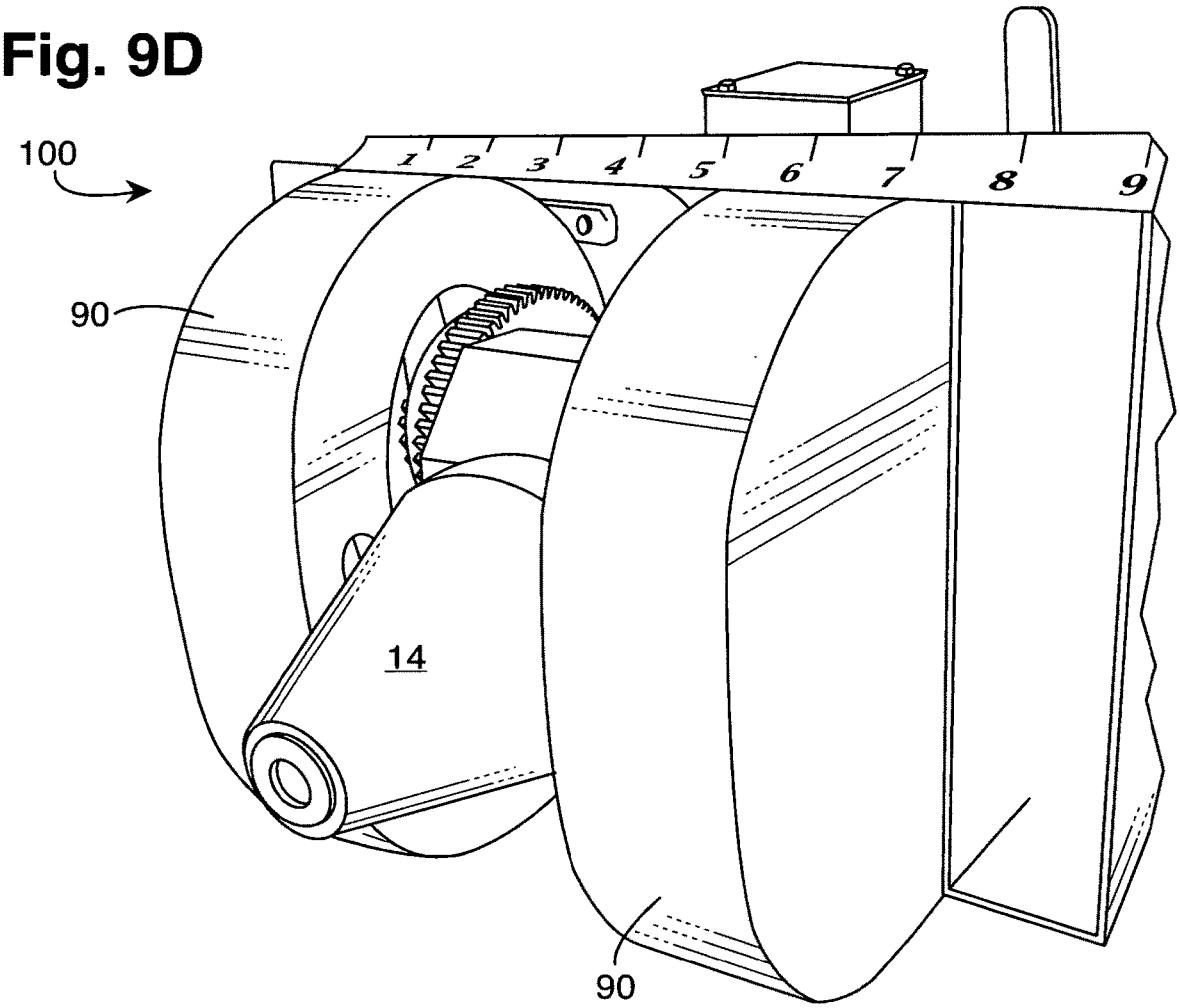

FIGS. 9A-9D are perspective views of an embodiment of a head of FIG. 1, with FIG. 9A showing assembled head components generally between two side plates; FIG. 9B being a view of such assembled head components as in FIG. 9A but generally between gears of a tilt spur gear set; FIG. 9C showing the assembled head with a cover; and FIG. 9D showing the assembled head with cover of FIG. 9C along with a ruler on top, the scale of the ruler being set forth in inches.

Figure 10:
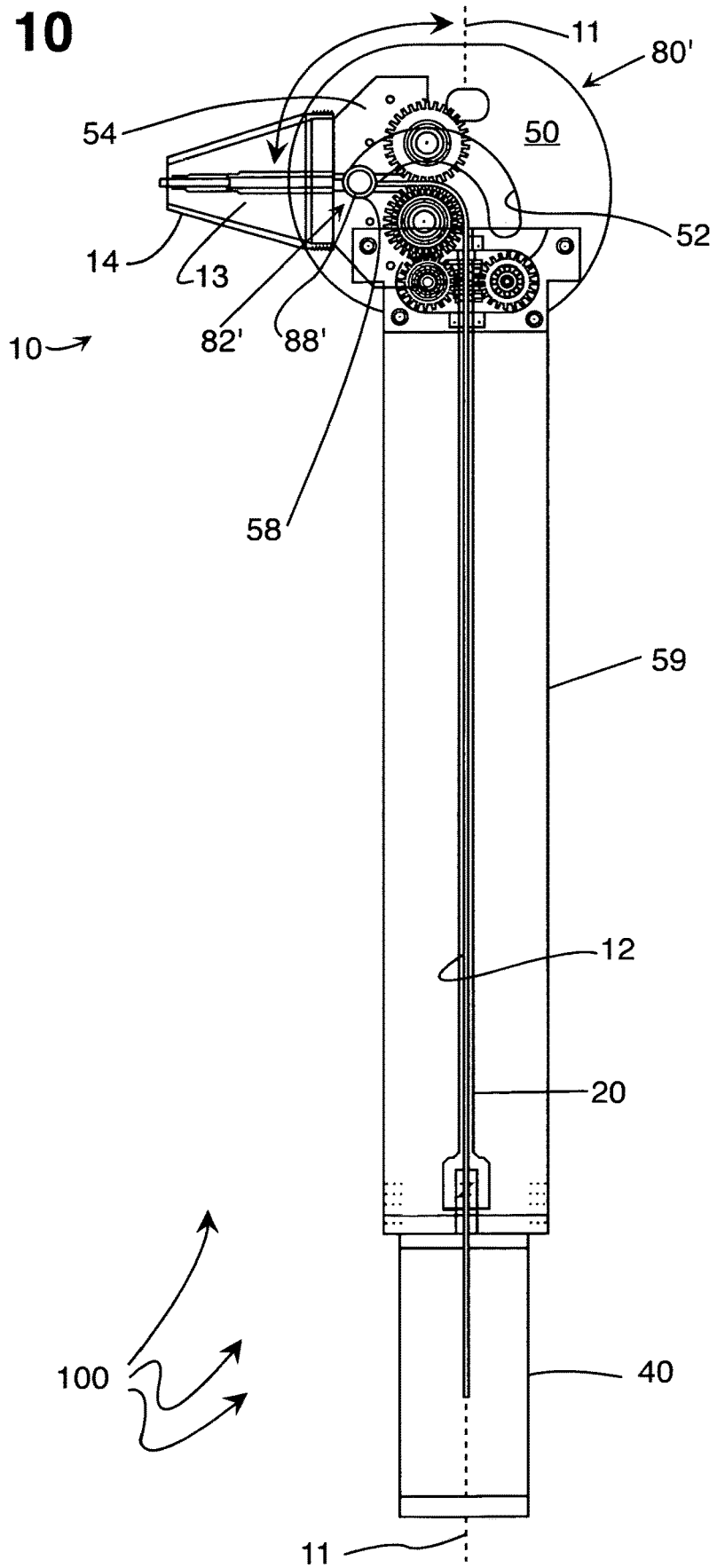

FIG. 10 is a side plan view of another wire arc spray swivel head embodiment hereof. It has a manually adjustable tip that can swivel to be set anywhere within an about 90-degree arc.

ILLUSTRATIVE DETAIL

The invention can be further understood by, in addition to the foregoing, the detail set forth below. As with the foregoing, the following may be read in view of the drawings and should be taken in an illustrative but not necessarily limiting sense.

The present device for spray coating comprises a wire arc spray head that can swivel in a pivoting motion. Notably, the head includes arc-making contact points and a carrier gas outlet, which can swivel with feed wire in a pivoting motion with the head. This enables superior, highly consistent spraying since the arc can be formed at a location closer to the spray tip opening and hence the workpiece. Beneficially, to swivel in a pivoting motion refers to a pivoting motion that changes an angle of a spray tip of the head from a first position to a second position with respect to a central axis of the head such that the pivoting motion does not lie in a plane perpendicular to the central axis. In other words, such a beneficial swivel in a pivoting motion articulation flexes the position of the spray tip with respect to the central axis rather than merely twisting it around the central axis. The head may be adjusted and stopped along a radial arc from the swiveling. This may be accomplished automatically or manually.

Operation may be robotic, automatic such as with electric motors and controllers, or manual.

The head can be a gas-carried, wire arc spray, manual or robotic spray torch head, its spray tip capable of being selectively swiveled through an arc between at least two operating positions. The gas may be inert or reactive, be pure or in a mixture of gases, and be flowing as at about ambient pressure or flowing under increased pressure. The gas may be selected from the group consisting of helium, argon, nitrogen, oxygen, air, and so forth. For example, the gas can be pressurized air that flows through the head. The wire feed stock may be of any suitable material, which may include a metal, to include a hollow core metal wire filled with a suitable substance, say, a powder or another metal wire. The metal of the wire may be pure or present as an alloy, and be made of or include aluminum, copper, brass, bronze, stainless steel, tin, tantalum, titanium, zinc, and so forth. For example, the metal of the metal wire can be zinc. The powder may include at least one metal, metal alloy, ceramic, carbide, and organic compound, to include a combination thereof. The powder filler in a hollow core wire may be or include at least one inorganic compound such as a phosphate, oxide, and so forth of a suitable metal, for example, a calcium phosphate and/or a magnesium oxide and so forth. An example of a combination wire feed stock is a calcium phosphate, say, hydroxyapatite, core, titanium-sheathed wire, which may provide a porous coating as disclosed by McDemus et al., Pub. No. US 2015/0374882 A1. The arc, taken geometrically, may be, for example, a 180-degree arc in a plane in which a central axis of the head lies with a first operating position at a 90-degree angle with respect to the axis, a second operating position opposite the first operating position, and further operating positions intermediate the first and second operating positions. An example of a further operating position therein is one that is parallel with the central axis. The arc may be less or greater than a 180-degree arc. As another example, the arc, taken geometrically, may be a 90-degree arc in a plane in which a central axis of the head lies, with a first operating position at a 90-degree angle from the central axis, a second operating position in or parallel with the central axis, and further operating positions intermediate the first and second operating positions.

Further structure can make up the device. Such structure may be external to the torch as to include, for instance, a gantry. The gantry may assist in robotic spraying of a workpiece. For example, the gantry may be operated in robotic spraying, parallel with the length of a long-length structural metal I-beam, say, one with a 20-, 50- or 100-foot length, or greater, for example, one with a 150-foot length. The further structure may be internal the torch as to include a swivel stop to secure intermediate head angles between fixed extremes, for instance, in a manual torch.

The workpiece can be any substance to which the spray coating can be applied, and be in any suitable configuration and size. For instance, the workpiece can be made of a metal or alloy of or including aluminum, carbon steel, copper, tin, and so forth. The workpiece may be configured as a flat sheet, or a bent or formed sheet, rod, beam, cube, pyramid, sphere, ellipsoid or other three-dimensional shape, and may be of any suitable size.

With reference to the drawings, arc spray 8 can coat workpiece 9 by device for spray coating 100, to include wire arc spray swivel head 10. Further structure 80, 80' can be present.

The wire arc spray swivel head 10, which may be called a torch head, includes spray hole 10H in tip 10T, which can swivel in a pivoting motion with respect to first and second members associated respectively with first and second central axes 11, 11' so as to adjust their relative positions. Wire feed stock 12, for example, zinc twin arc wire, can be fed into the spray head 10 and made subject to an electric arc at or about twin arc wire contact point 13, in or about arc chamber 13', with a suitable gas, for example, air, being passed by to make the arc spray 8. The spray head 10 can be made to also include or have associated therewith the following features:

| Numeral | Feature |
|---|---|
| 14 | Cap, also known as an air cap, e.g., made of aluminum |
| 16 | Air cap thread mount, e.g., made of aluminum |
| 18 | Air cap nozzle, e.g., made of brass |
| 19 | Set screw access window |
| 20 | Air pathway |
| 22 | Air and power cable unit for supplying air and electrical power |
| 24 | Air and power connector, e.g., made of brass, which connects with the air and power cable 22 and directs air therefrom to the air pathway 20 |
| 26 | Air tube connector, e.g., made of Nylatron ® engineered nylon plastic |
| 27 | Flexible air hose, e.g., latex plastic, connected with the air pathway 20 with the air tube connector 26 |
| 28 | Air nozzle, e.g., made of Nylatron ® engineered nylon plastic, which receives air from the flexible air hose 27 and directs it out the air cap nozzle 18 |
| 30 | Contact tip, e.g., made of copper, which contacts the wire feed stock 12 |
| 32 | Distal wire contact tube, e.g., made of copper, primarily which directs electrical power to the contact tip 30, and through which passes the zinc wire 12 |
| 34 | Flexible power strap, e.g., made of tinned copper mesh, which directs electrical power to the distal wire contact tube 32 |
| 35 | Distal power strap clamp, e.g., made of brass, which secures a distal end of the flexible power strap 34 to the distal wire contact tube 32 |
| 36 | Power isolation bushing, e.g., made of Teflon ® polytetrafluoroethylene in a shape resembling a pulley, in which the flexible power strap 34 resides |
| 37 | Deep wire contact tube, e.g., made of copper, primarily from which electrical power received via the air and power cable 22, through which passes the zinc wire 12, runs to the flexible power strap 34 |
| 38 | Deep power strap clamp, e.g., made of brass, which secures a deep end of the flexible power strap 34 to the deep wire contact tube 37 |
| 39 | Cable mount block, e.g., made of Nylatron ® engineered nylon plastic |
| 40 | Motor, e.g., DC motor model No. 051-209-5035 from Leeson Electric |

-continued

| Numeral | Feature |
|---|---|
| 41 | Motor mount plate, e.g., made of steel |
| 42 | Tip and connecter clamp, e.g., made of brass |
| 44, 44' | Drive shaft, e.g., made of steel |
| 45 | Drive shaft ball bearing |
| 46, 46' | Driving gear, e.g., worm, i.e., worm gear, made of hardened steel |
| 47 | Driven gear, e.g., worm wheel, i.e., planetary gear, made of brass |
| 48 | Driven gear shaft ball bearing |
| 49 | Gear set housing, e.g., made of aluminum |
| 50 | Side plate, e.g., steel |
| 52 | Angle travel slot in the side plate 50 |
| 54 | Tip housing, e.g., made of Nylatron ® engineered nylon plastic |
| 56 | Travel limit switch |
| 58 | Distal flange bushing, e.g., made of bronze |
| 59 | Torch body |
| 60 | First pinch drive spur gear, e.g., planetary gear made of steel |
| 62 | Second pinch drive spur gear, e.g., planetary gear made of steel |
| 64 | Pinch vee spur gear, e.g., planetary gear made of steel |
| 65 | Vee wheel gear wire roller |
| 66 | Vee wheel drive shaft, e.g., made of steel |
| 67 | Vee gear ball bearing |
| 68 | Isolation bushing, e.g., made of Nylatron ® engineered nylon plastic |
| 69 | Intermediate flange bushing, e.g., made of bronze |
| 70 | Tilt spur gear set, three gears, e.g., made of steel |
| 76 | Tilt drive shaft, e.g., made of steel. |

The further structure 80 may include arm 82 that supports and may move the spray head 10 with respect to the workpiece 9. The arm 82 may be movably mounted on gantry 88, which may have support member 89 that may be mounted on rail 89R for movement. The arm 82 and/or gantry 88 may be robotically controlled and manipulated. Such further structure 80 may be considered to be external to the torch head 10.

The further structure 80' may include swivel stop 82' to secure intermediate head angles between fixed extremes of a radial arc. The swivel stop 82' may be configured as knob 88' with a threaded shaft member attached thereto, which screws into the bushing 58 that rims in the housing guide slot 52 in the side plate 50. Tightening the knob 88' pinches the tilt housing 54 and housing guide slot 52 so as to hold the selected tilt angle in place. This can have special benefit when the wire arc spray swivel head 10 is a manually operatable embodiment. Such further structure 80' may be considered to be internal to the torch head 10.

With the device for spray coating 100, the following is further noted:

Outer cover or shroud 90 may be provided.

As to function control for automatic operation, air pressure, air flow, wire feed rate, and power on/off can be controlled external the head, for example, by a gantry robot controller with a pre-loaded program setting. With manual operation, air pressure, air flow, wire feed rate, and power on/off can be controlled by a separate stand-alone controller, which is set by an operator.

Air pressure can be controlled by an air regulator, which may be adjusted by hand. The on/off function with respect to regulation of the air pressure can be by an air solenoid such as may be controlled automatically or robotically such as by a gantry robot.

A wire feeder delivers wires 12 through the hoses to the torch head 10, which can have a motor control that is torque-based, applying a constant torque that allows rotations per minute (RPM) to vary, and the torch motor 40 is RPM-based. The torch head 10 pulls on the wire 12 in the hose, and the wire feeder supplies the wire 12 as needed to maintain wire feed rate. Thus, the torch controller maintains a constant RPM, and the wire feeder maintains a constant push/pressure. This typically works the same way for automatic and manual configurations.

The air flow, wire feed, and on/off functions can be controlled by a programmable logic control (PLC) controller. The rate of feed of the wire 12 is kept proportional to the rate of wire melting and spraying through the employment of a constant voltage power supply. As the current is increased, the wire 12 is fed faster. Thus, the amount of wire 12 melted is controlled by the current setting.

Automatic operation of the device 100 with its swivel spray head 10 can be such that there is a motor, for example, the motor 40, which turns the swivel head spray tip components such as the features 14, 18, 28, 30 and associated parts by use of controller 40', which can be an electronic controller. Such control can be by the controller 40' as a robot controller, a PLC controller, or any device capable of supplying electronic, electrical, electromagnetic, light and/or sound and so forth signal(s) to automatically adjust the position of the head 10. Thus, capable of swiveling together, among other components, are the arc-making contact points 30, carrier gas supply through the nozzle 28, and the air cap 14 that directs the air and the molten material from the feed wire 12 for spraying.

A manual device 100 does not have a motor to adjust the swivel head 10. Rather, it is manually adjusted. The knob 88' or a bolt and nut to be loosened and tightened can be employed to allow for the manual adjustment and then tightening at the desired angle for securement at that angle. Generally the manual device is simpler and more compact than the automatic.

The device 100 with its swivel spray head 10 being manually adjustable can be used in applications where a fixed spray angle is necessitated, and a high, if not the best, quality coat is desired. Such applications include the inside surface of a pipe that requires a coating. This would apply for coating requirements on the inside of any shaped object that would otherwise require the manipulation of the device or object by other positioning devices such as robots and other manipulators. An automatically adjustable swivel spray head 10 may be preset to have a predetermined angle of spray and be similarly operated.

Numerical values herein may be considered to be approximate or exact.

The following examples further illustrate the invention.

Example 1

Construction and operation of an embodiment of the present wire arc spray swivel head, which would have an about 180-degree radial arc of head swivel, in general, may be as follows, seeing, e.g., FIGS. 1, 2, 3, 4, 5A, 5B, 5C, 5D, 5E, 6, 7, 8, 9A, 9B, 9C and 9D:

1. Set of zinc wires 12 is delivered to the torch through a set of cables containing air and electrical power, i.e., air- and power-containing cable 22.
2. Each zinc wire 12 is fed in parallel to the head 10 where each wire 12 wraps around a pinch roller 65 at a 90-degree angle so both zinc wires 12 meet straight head on.
3. The zinc wire 12 is held tight to each set of pinch rollers 65. The wire 12 is pulled from the cables 22 and pushed straight through the head 10 at a 0-degree angle. When a different angle is called for, for example, a +90-degree angle or a −90-degree angle, the tilt motor 40 and drive is employed to change the angle of the head cap 14.
4. The pinch rollers 65 have a knurled surface to ensure a positive grip on the zinc wire 12 to feed it into arc chamber 13' evenly.
5. The corresponding sets of cable units 22, other power supply components such as the wire contact tubes 32, 37, power strap 34, and pinch rollers 65 are insulated from the other to prevent arcing of wire 12 before meeting in the arc chamber 13'.
6. Within the head 10 one copper contact tip 30, in any form that conducts electricity, is pressed against each wire 12 to electrify the wire 12 as it enters the arc chamber 13'.
7. Inner surfaces of the air cap 14 can be coated with an anti-bond and anti-conductive coating such as Teflon® polytetrafluoroethylene so that arced zinc will not stick and the zinc wires 12 will not short out on an internal wall of the arc chamber 13'.
8. Compressed air within the air- and power-containing cables 22 enters the arc chamber 13' through the air pathway 20 and its associated parts. This can include the air connector 26 mounted within the air cap 14.
9. Compressed air enters the arc chamber 13' through the air nozzle 28, producing an exiting air flow and swirling action, which also helps to prevent arc zinc from sticking to the internal wall of the arc chamber 13'.
10. As the pinch rollers 65 feed the electrically charged zinc wire 12 into the arc chamber 13', these two zinc wires 12 touch each other, making an electrical arc that melts the zinc.
11. One center air jet 28, or multiple air jets, at the back of the chamber 13' atomizes the zinc and blows the zinc droplets forward while angled air ports on the sides of the arc chamber 13' provide for rotation of the air, which keeps the arc chamber 13' cool.
12. As the air swirls around within the arc chamber 13', the zinc droplets are forced out of the arc chamber 13', which forms the arc spray 8.
13. With respect to the central axis 11, the arc chamber 13' can be rotated plus 90-degree and a minus 90-degree angles, and angles in between and exceeding those right angles, notwithstanding that cables, i.e., the air- and power-containing cables 22, enter the torch body 59.
14. The arc chamber 13' pivots on the two vee wheel drive shafts 66 and bushing 69.
15. From the cables 22, the two zinc wires 12 enter through the contact tubes 37 held in the cable mount block 39; are pulled through the geared vee wheel 65; then enter the second set of contact tubes held in place by the tip housing 54; and meet in the center at the end of the air cap 14.
16. The two zinc wires 12 are fed by a wire feeding unit with a first small servo motor 40, with the driving gear 46 on shaft 44 connected to the motor 40, for instance, the aforementioned worm gear, although it could be provided with any other suitable configuration such as a bevel gear set and so forth and the like, which drives complimentary gears mounted on the tilt spur gear set 70 mounted in the tip housing 54. In lieu of the motor 40, manual feed of the zinc wires 12 may be carried out.
17. The arc chamber 20 is rotated (tilted) by a second small servo motor such as the motor 40, with gear 46 on the shaft 44' connected to the motor 40, say, a worm gear, although it could be provided with any other suitable configuration such as a bevel gear set and so forth and the like, which drives complimentary tilt gear set 70. In lieu of the servo motor 40, manual adjustment of rotation of the arc chamber 13' may be carried out.
18. The arc chamber nozzle 18 can be provided in conjunction with an air cap 14 that has a configuration that helps to shape the zinc droplet spray 8.

Example 2

Construction and operation of an embodiment of the present wire arc spray swivel head, which would have an about 90-degree radial arc of head swivel, in general, may be as set forth in Example 1 but having roughly half of those moving component parts. See, e.g., FIG. 10.

CONCLUSION TO THE INVENTION

The present invention is thus provided. Various feature(s), part(s), step(s), subcombination(s) and/or combination(s) can be employed with or without reference to other feature(s), part(s), step(s), subcombination(s) and/or combination(s) in the practice of the invention, and numerous adaptations and modifications can be effected within its spirit, the literal claim scope of which is particularly pointed out as follows:

What is claimed is:

1. A device for thermal spray coating, which comprises a wire arc spray swivel head having the following:

a first member including a torch body, with a first central axis passing through the torch body; and pivotally attached to the first member, a second member including electric arc-making contact points and a carrier gas outlet in a spray tip having a distal end thereto, with a second central axis passing through the second member;

wherein the second member is configured to pivot with feed wire in a pivoting motion with respect to the torch body when the wire arc spray swivel head is operated for spraying the thermal spray coating, with the pivoting motion being such that the second member is configured to be adjusted pivotally with respect to the torch body while the second member remains attached to the torch body to flex within a curvilinear arc from a first position in relation to the torch body to a second position in relation to the torch body such that in the first position a first angle is formed between said first central axis and said second central axis, and in the second position a second angle is formed between said first central axis and said second central axis that is different from the first angle, wherein the second member flexes with respect to the first member, by which the second member and said second central axis is moved from the first position to the second position in or parallel to a predetermined, fixed plane in which said first central axis of the torch body resides;

wherein, during operation, the feed wire is provided as solid feed wire pulled into the first member and from there fed into the second member to be melted about the electric arc-making contact points and sprayed out the spray tip with carrier gas, which passes through the second member, past the electric arc-making contact points, and out the carrier gas outlet for thermal spraying therefrom; wherein a stream-deflecting tip construction is avoided such that, during operation, the melted spray is sprayed out the spray tip with the carrier gas in a stream along a direction at which the melted spray is initially aimed without deflection by another compressed gas after the stream is formed; and wherein, when operating for the thermal spray coating, the device operates to thermal spray coat a workpiece.

2. The device of claim 1, which is automatic, in that a motor causes the electric arc-making contact points and carrier gas outlet in the spray tip to swivel with feed wire in said pivoting motion in response to receiving a signal from a controller therefor.

3. The device of claim 2, wherein the controller signal is electronic.

4. The device of claim 3, wherein the controller is selected from the group consisting of a robot controller and a PLC controller.

5. The device of claim 1, wherein the wire arc spray swivel head further includes a cap at the spray tip that is configured to direct carrier gas from the carrier gas outlet and molten material from the electric arc-making contact points when the device is operated and the molten material is sprayed.

6. The device of claim 1, which is mounted on structure external to the wire arc spray swivel head such that during operation the device is adapted to be positioned for at least one motion in addition to that provided by said pivoting motion of the electric arc-making contact points and the carrier gas outlet in the spray tip.

7. The device of claim 6, wherein the structure external to the wire arc spray swivel head includes at least one of a gantry and a robot.

8. The device of claim 7, wherein the at least one of a gantry and a robot is adapted to manipulate the wire arc spray swivel head in multiple angles and positions along the workpiece for the thermal spray coating; and the device is configured to thermal spray coat a workpiece for the thermal spray coating that is an elongate object.

9. The device of claim 8, wherein the workpiece for the thermal spray coating is an I-beam.

10. The device of claim 1, which is manual, in that the device does not have a motor to adjust the second member from the first position to the second position.

11. The device of claim 10, which is able to be sprayed by hand.

12. The device of claim 10, wherein a locking device is included, which is adapted to be tightened and released for manually adjusting and then securing in position the electric arc-making contact points and the carrier gas outlet in the spray tip; and the second member flexes with respect to the first member through a radial arc at least from about 15 degrees to about 90 degrees.

13. A method of thermal spray coating a workpiece comprising steps, not necessarily conducted in series, as follows:

providing the workpiece to be thermal spray coated;

providing a device for thermal spray coating, which includes a wire arc spray swivel head having the following:

a first member including a torch body, with a first central axis passing through the torch body; and pivotally attached to the first member, a second member including electric arc-making contact points and a carrier gas outlet in a spray tip having a distal end thereto, with a second central axis passing through the second member;

wherein the second member is configured to pivot with feed wire in a pivoting motion with respect to the torch body when the wire arc spray swivel head is operated for spraying the thermal spray coating, with the pivoting motion being such that the second member is configured to be adjusted pivotally with respect to the torch body while the second member remains attached to the torch body to flex within a curvilinear arc from a first position in relation to the torch body to a second position in relation to the torch body such that in the first position a first angle is formed between said first central axis and said second central axis, and in the second position a second angle is formed between said first central axis and said second central axis that is different from the first angle, wherein the second member flexes with respect to the first member, by which the second member and said second central axis is moved in or parallel to a predetermined, fixed plane in which said first central axis of the torch body resides; wherein, during operation, the feed wire is provided as solid feed wire pulled into the first member and from there fed into the second member to be melted about the electric arc-making contact points and sprayed out the spray tip with carrier gas, which passes through the second member, past the electric arc-making contact points, and out the carrier gas outlet for thermal spraying therefrom; wherein a stream-deflecting tip construction is avoided such that, during operation, the melted spray is sprayed out the spray tip with the carrier gas in a stream along a direction at which the melted spray is initially aimed without deflection by another compressed gas after the stream is formed; and wherein, when operating for the thermal spray coating, the device operates to thermal spray coat the workpiece;

providing wire feed stock in a solid state to the head of the device;

swiveling the head in a pivoting motion to orient it in position for spraying the workpiece;

providing electric power to the solid wire feed stock such that the solid wire feed stock is changed into a state suitable for thermal spraying;

providing a carrier gas under pressure to the device;

passing the carrier gas by the feed stock changed into a suitable state for thermal spraying to form a molten spray for thermal coating the workpiece; and carrying the molten spray by the carrier gas to the workpiece such that thermal spray coating is carried out on the workpiece.

14. The method of claim 13, wherein the device is automatic, in that a motor causes the electric arc-making contact points and the carrier gas outlet in the spray tip to swivel with the solid wire feed stock in said pivoting motion in response to receiving a signal from a controller therefor.

15. The method of claim 13, wherein the device is manual, in that the device does not have a motor to adjust the second member from the first position to the second position.

16. A device for thermal spray coating, which comprises a wire arc spray swivel head having the following:

a first member including a torch body, with a first central axis passing through the torch body; and pivotally attached to the first member, a second member including electric arc-making contact points and a carrier gas outlet in a spray tip having a distal end thereto, with a second central axis passing through the second member;

wherein the second member is configured to pivot with feed wire in a pivoting motion with respect to the torch body when the wire arc spray swivel head is operated for spraying the thermal spray coating, with the pivoting motion being such that the second member is configured to be adjusted pivotally with respect to the torch body while the second member remains attached to the torch body to flex within a curvilinear arc from a first position in relation to the torch body to a second position in relation to the torch body such that in the first position a first angle is formed between said first central axis and said second central axis, and in the second position a second angle is formed between said first central axis and said second central axis that is different from the first angle, wherein the second member flexes with respect to the first member, by which the second member and said second central axis is moved from the first position to the second position in or parallel to a predetermined, fixed plane in which said first central axis of the torch body resides;

wherein the device is automatic, in that a motor causes the electric arc-making contact points and the carrier gas outlet in the spray tip to swivel with the feed wire in said pivoting motion in response to receiving an electronic signal from a computer that is not a PLC controller therefor and/or from a PLC controller therefor; wherein, during operation, the feed wire is provided as solid feed wire pulled into the first member and from there fed into the second member to be melted about the electric arc-making contact points and sprayed out the spray tip with carrier gas, which passes through the second member, past the electric arc-making contact points, and out the carrier gas outlet for thermal spraying therefrom; wherein a stream-deflecting tip construction is avoided such that, during operation, the melted spray is sprayed out the spray tip with the carrier gas in a stream along a direction at which the melted spray is initially aimed without deflection by another compressed gas after the stream is formed; and wherein, when operating for the thermal spray coating, the device operates to thermal spray coat a workpiece.

17. The device of claim 16, wherein the wire arc spray swivel head further includes a cap at the spray tip that is configured to direct carrier gas from the carrier gas outlet and molten material from the electric arc-making contact points when the device is operated and the molten material is sprayed.

18. A device for thermal spray coating, which comprises a wire arc spray swivel head having the following:

a first member including a torch body, with a first central axis passing through the torch body; and pivotally attached to the first member, a second member including arc-making contact points and a carrier gas outlet in a spray tip having a distal end thereto, with a second central axis passing through the second member;

wherein the second member is configured to pivot with feed wire in a pivoting motion with respect to the torch body when the wire arc spray swivel head is operated for spraying the thermal spray coating, with the pivoting motion being such that the second member is configured to be adjusted from a first position to a second position in relation to the torch body such that in the first position a first angle is formed between said first central axis and said second central axis, and in the second position a second angle is formed between said first central axis and said second central axis that is different from the first angle; wherein, when operating for the thermal spray coating, the device operates to thermal spray coat a workpiece; and wherein the wire arc spray swivel head includes a spray hole in the distal end of the spray tip as the carrier gas outlet; the feed wire is provided as a first feed wire and a second feed wire, the first and second feed wires adapted to be fed into the wire arc spray swivel head and made subject to the arc-making contact points, which are provided by twin arc wire contact points in an arc chamber, with the carrier gas being passed by the twin arc wire contact points during operation to make an arc spray, which is passed out the carrier gas outlet; and also includes the following:

In the spray tip, a gas cap and a gas cap nozzle having the spray hole;

A carrier gas pathway;

A carrier gas and power cable unit for supplying the carrier gas to the carrier gas pathway, and supplying electrical power;

A carrier gas and power connector, which connects with the carrier gas and power cable unit and directs the carrier gas therefrom to the carrier gas pathway and connects the electrical power;

A flexible carrier gas hose connected with the carrier gas pathway to receive the carrier gas from the carrier gas pathway;

A gas nozzle, which receives the carrier gas from the flexible carrier gas hose and directs the carrier gas out the gas cap nozzle;

A first contact tip and a second contact tip, the first and second contact tips positioned inside the gas cap, the first contact tip configured to contact the first feed wire and the second contact tip configured to contact the second feed wire, and by which passes the carrier gas;

A first distal wire contact tube and a second distal wire contact tube, the first distal wire contact tube configured to direct electrical power to the first contact tip and the second distal wire contact tube configured to direct electrical power to the second contact tip, and through the first distal wire contact tube the first feed wire is passed during operation and through the second distal wire contact tube the second feed wire is passed during operation;

A first flexible power strap and a second flexible power strap, the first flexible power strap adapted to direct electrical power to the first distal wire contact tube and the second flexible power strap adapted to direct electrical power to the second distal wire contact tube;

A first power isolation bushing and a second power isolation bushing, each having a circumferential groove; in the circumferential groove of the first power isolation bushing, the first flexible power strap resides; and, in the circumferential groove of the second power isolation bushing, the second flexible power strap resides;

A first deep wire contact tube and a second deep wire contact tube; from the first deep wire contact tube, electrical power received via the carrier gas and power cable unit runs to the first flexible power strap; and, from the second deep wire contact tube, electrical power received via the carrier gas and power cable unit runs to the second flexible power strap; through the first deep wire contact tube, the first feed wire passes during operation; and, through the second deep wire contact tube, the second feed wire passes during operation;

A first rotating electric motor, and a second rotating electric motor;

For providing feeding of the first and second feed wires, a wire feeding unit having a first driving gear selected from the group consisting of a first worm gear and a first bevel gear activated by the first rotating electric motor, which drives a first set of complimentary gears mounted on a first tilt spur gear set mounted in a tip housing, with each feed wire of the pair of feed wires pulled through a geared vee wheel;

A gear set housing;

A pair of opposing side plates, each of which having an angle travel slot therein for receiving a tilt spur gear axle;

For providing said pivoting motion, a second driving gear selected from the group consisting of a second worm gear and a second bevel gear activated by the second rotating electric motor, which drives a second set of complimentary gears mounted on a second tilt spur gear set.

19. The device of claim 1, wherein the second member flexes with respect to the first member through a radial arc of at least about 15 degrees.

20. The device of claim 19, wherein the second member flexes with respect to the first member through a radial arc at least from about 30 degrees to about 180 degrees.

* * * * *